US005233851A

United States Patent [19]

Florian

[11] Patent Number: 5,233,851

[45] Date of Patent: Aug. 10, 1993

[54] HOUSING AND ADAPTOR FOR INTERCHANGEABLE CORE AND INSERT CYLINDERS

[76] Inventor: David W. Florian, 35 Copper Ridge, Southington, Conn. 06489

[21] Appl. No.: 860,146

[22] Filed: Mar. 30, 1992

[51] Int. Cl.[5] ..... E05B 9/04

[52] U.S. Cl. ..... 70/367; 70/369; 70/370; 70/374; 70/379 R

[58] Field of Search ..... 70/367-369, 70/374, 379 R, 370-373, 449, 462, 466

[56] References Cited

U.S. PATENT DOCUMENTS

| | | | |
|---|---|---|---|
| 1,986,676 | 1/1935 | Hurd | 70/369 |
| 2,014,233 | 9/1935 | Keil | 70/367 |
| 2,620,648 | 12/1952 | Quigley | 70/379 R |
| 3,404,549 | 10/1968 | Best | 70/373 |
| 4,338,806 | 7/1982 | Cox | 70/373 X |
| 4,424,693 | 1/1984 | Best et al. | 70/369 |
| 4,672,828 | 6/1987 | Theriault | 70/373 |
| 4,926,670 | 5/1990 | Deforrest, Sr. | 70/374 |

FOREIGN PATENT DOCUMENTS

| | | | |
|---|---|---|---|
| 2723887 | 12/1978 | Fed. Rep. of Germany | 70/369 |
| 2216944 | 10/1989 | United Kingdom | 70/417 |

*Primary Examiner*—Lloyd A. Gall
*Attorney, Agent, or Firm*—Bachman & LaPointe

[57] ABSTRACT

A lock is disclosed which includes a housing having an inside bore, a cylinder selected from a group consisting of interchangeable core cylinders and insert cylinders, the cylinder having an outer contour, the inside bore of the housing being at least as large at any point as the outer contour of the cylinder, and a device for adapting the inside bore of the housing to correspond to the outer contour of the cylinder. Also described is a transmission assembly mounted to the housing and cooperating with the cylinder to impart desired motion to a latch mechanism of the lock. An advantage of the lock is that it may accommodate distinctively different cylinder types with different form, fit and function.

15 Claims, 5 Drawing Sheets

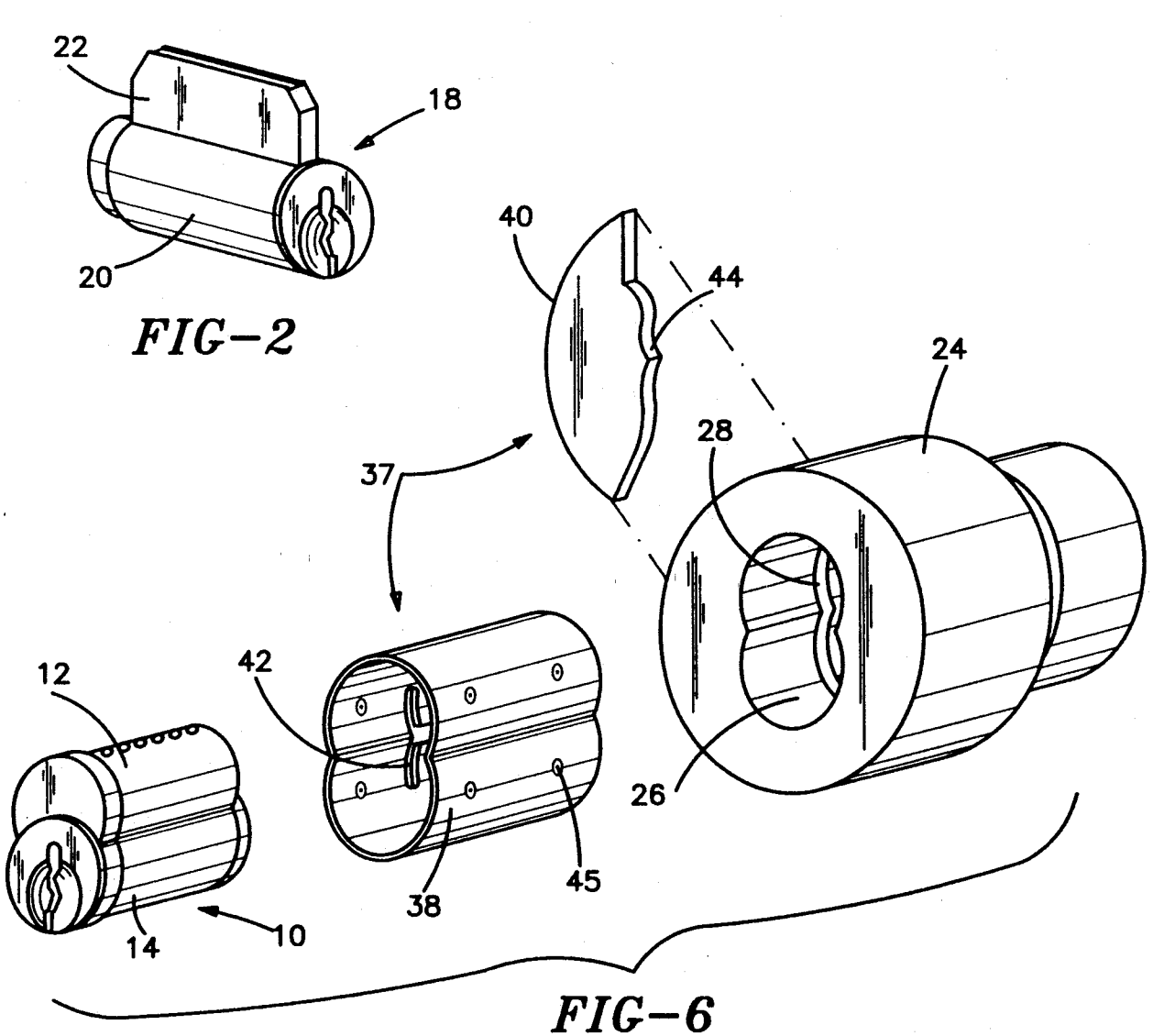
FIG-6
FIG-2
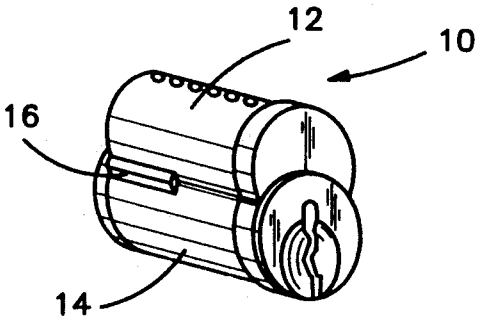
FIG-1
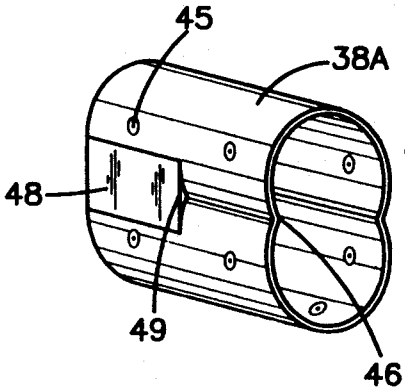
FIG-7

HOUSING AND ADAPTOR FOR INTERCHANGEABLE CORE AND INSERT CYLINDERS

BACKGROUND OF THE INVENTION

1. Field of the Invention

The invention pertains to the field of lock mechanisms, and, more particularly, to a lock assembly for use with lock cylinders of interchangeable core cylinder and insert cylinder types.

2. Description of the Related Art

Numerous types of cylinders for locks are known and popularly used for various applications. For example, locks known in the industry as "interchangeable core cylinder" locks are used to provide a lock wherein the cylinder can be removed from the lock housing through the use of a control key. A different interchangeable core cylinder can then be inserted into the lock housing, whereby the user can quickly and easily change a lock or locks without calling a locksmith.

Another frequently used lock cylinder is known in the industry as an "insert cylinder". Insert cylinders are installed through the back of a lock housing by a locksmith.

These two widely used types of lock cylinders have different shapes and functions. These differences necessitate the use of a different housing for each type of lock.

Locksmiths are frequently called upon to change locks on short notice. Frequently, the locksmith cannot be certain as to what type of lock or lock cylinder will be used until arriving at the work site. Thus, in order to avoid the impracticality of making several visits to the work site, the locksmith must carry a large selection of various types of lock cylinders and the lock parts which are used with each type of cylinder. However, to carry such a large quantity of components is also impractical.

It is, accordingly, a principal object of the present invention to provide a housing for a cylinder of a lock which, with a minimum number of parts, can be used to accommodate cylinders of either the interchangeable core or insert type locks.

Conventional interchangeable core and insert cylinder locks also use different mechanisms or transmissions for interacting the lock cylinder with a latch mechanism of the lock. Such interacting mechanisms are frequently designed to supply "lazy cam" rotation, or a degree of rotation of the lock cylinder which will not be transmitted to the latch mechanism of the lock. As is known in the art, such lazy cam action is necessary to allow a key to be removed from a lock after it has been locked or unlocked. Different cylinder types use different lazy cam assemblies with resulting structural differences between the housing used for interchangeable core cylinders and the housing used for insert cylinders.

It is, therefore, a further object of the present invention to provide a transmission assembly, which is affixed to the housing and which easily adapts to either of the aforesaid types of cylinders to provide the desired interaction between the cylinder and the latch mechanism of the lock.

SUMMARY OF THE INVENTION

The aforesaid objects, and others, are met by a lock which, according to the invention, comprises a housing having an inside bore; a cylinder selected from a group consisting of interchangeable core cylinders and insert cylinders, said cylinder having an outer contour, the inside bore of the housing being at least as large at any point as the outer contour of any cylinder selected from said group of cylinders; and means for adapting the inside bore of the housing to correspond to the outer contour of the cylinder, whereby any cylinder selected from said group of cylinders can be disposed within the housing.

According to a preferred embodiment of the invention, when the cylinder used is an interchangeable core cylinder having a locking lug, the means for adapting preferably comprises a sleeve disposed within the inside bore of the housing and having an inside contour corresponding to the outer contour of the interchangeable core cylinder, and having a ledge means for interacting with the locking lug.

According to another alternate embodiment of the invention, when the cylinder used is an insert cylinder having a protruding rectangular member, said means for adapting preferably comprises an overlay member disposed within the housing and interacting with the rectangular member so that, in combination, the overlay member and the insert cylinder have an outer contour corresponding to the inside bore of the housing.

According to still another preferred embodiment of the invention, the lock further comprises a transmission means mounted to the housing and cooperating with the cylinder to impart desired motion to a latch mechanism of the lock.

The transmission means preferably comprises, according to a preferred embodiment of the invention, an assembly plate mounted to the housing, a cam plate rotatably mounted to the assembly plate in registry with a blade, a tail piece protruding from the cam plate for interaction with said latch mechanism of the lock, and means for imparting rotation from the cylinder to the blade.

Further features and advantages of the present invention will appear hereinbelow.

BRIEF DESCRIPTION OF THE DRAWINGS

A detailed description of the invention follows, with reference to the attached drawings, in which:

FIG. 1 is a perspective view of an interchangeable core cylinder;

FIG. 2 is a perspective view of an insert cylinder;

FIG. 6 is an exploded perspective view of a preferred embodiment of the invention;

FIG. 7 is perspective view of an alternate embodiment of an element of the preferred embodiment of FIG. 6;

DESCRIPTION OF THE PREFERRED EMBODIMENTS

Figure 4:
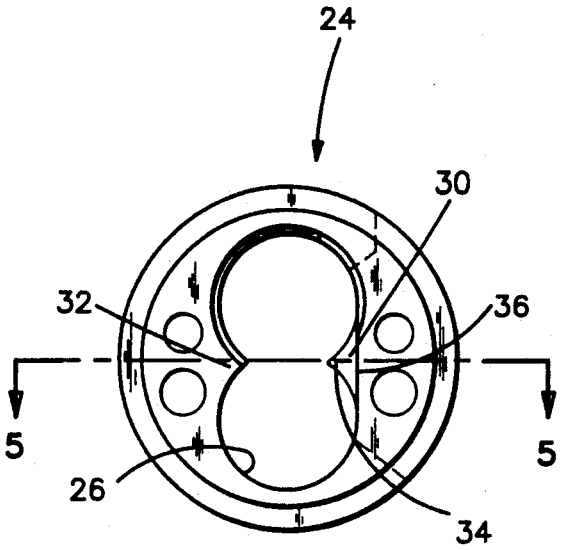
FIG. 4 is a rear view of the housing of FIG. 3.

With reference to the drawings, a detailed description of the preferred embodiments of the invention will be given.

As indicated above, the lock of the present invention is designed for use with lock cylinders of either the interchangeable core or insert type. Cylinders of the interchangeable core and insert type are illustrated, respectively, in FIGS. 1 and 2. These are intended to be illustrative only and naturally various other specific designs may readily be used.

Referring to FIG. 1, a lock cylinder of the "interchangeable core" type is generally depicted. A standard interchangeable core cylinder 10 is placed in a housing and has a shape similar to that of two intersecting cylinders. As is known in the art, the upper cylinder 12 generally houses a pin structure of the lock, while the lower cylinder 14 accommodates the keyway of the lock. The pin structure of upper cylinder 12 extends into the keyway of lower cylinder 14 to provide locking action. The interchangeable core cylinder 10 has a locking lug 16 which holds the cylinder in place in the housing and which, as is known in the art, is actuated by a control key (not shown) to remove the interchangeable core cylinder 10 from the housing of the lock. The locking lug 16 is disposed against a ledge means which must be provided in the housing for use with an interchangeable core cylinder 10. When the interchangeable core cylinder 10 is to be removed, a control key is used which withdraws locking lug 16 into the interchangeable core cylinder 10 and allows the cylinder 10 to be pulled out of the housing.

With reference now to FIG. 2, another type of frequently used lock cylinder, known as an insert cylinder 18, is illustrated. Insert cylinders are well known in the art and have a lower cylindrical section 20 which encompasses the keyway of the cylinder and an upper rectangular shaped section 22, known in the industry as a "bible", which houses the pin structure of the lock. The pin structure extends into the keyway to provide the desired locking action.

Figure 5:
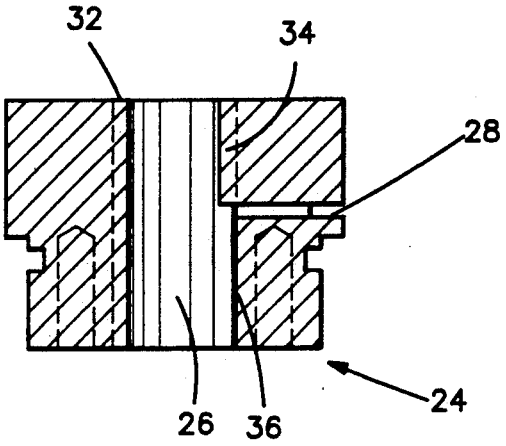
FIG. 5 is a cross section taken along the line 5—5 of FIG. 4.
Figure 3:
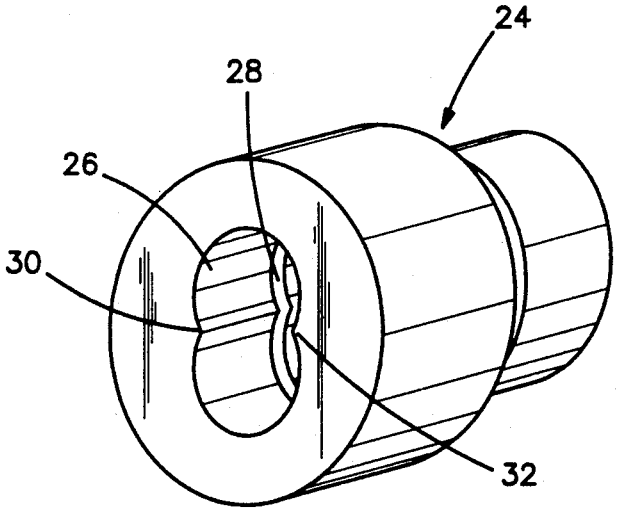
FIG. 3 is a perspective view of a housing according to the invention.

With reference now to FIGS. 3-5, a housing 24 according to the present invention is a generally cylindrical structure having an inside bore 26. The inside bore 26 of housing 24 has the shape of two substantially parallel intersecting cylinders.

The size of inside bore 26 is sufficient to accommodate the largest features, at any point, of either the interchangeable core cylinder or the insert cylinder to be used. In other words, the inside bore must be at least as large as the largest of the outer contour of an interchangeable core cylinder or insert cylinder. Each contour of the inside bore 26 must be at least large enough to accept the outer contour of either cylinder for which housing 24 may be used.

FIGS. 4 and 5 illustrate with more detail the contours of the inside bore 26. Ridges 30, 32 are formed at points of intersection of the cylinders of inside bore 26. One of these ridges 30 is preferably distorted to provide an extended region 34 which protrudes into the inside bore 26 of the housing and a cut back region 36 which may be machined back to form a substantially flat wall. The function of the extended region 34 and cut back region 36 will be more fully described below.

With further reference to FIGS. 3-5, the housing 24 also preferably includes a slot 28 which is cut through a portion of a wall of the housing 24 and has a function also to be fully described hereinbelow.

Figure 8:
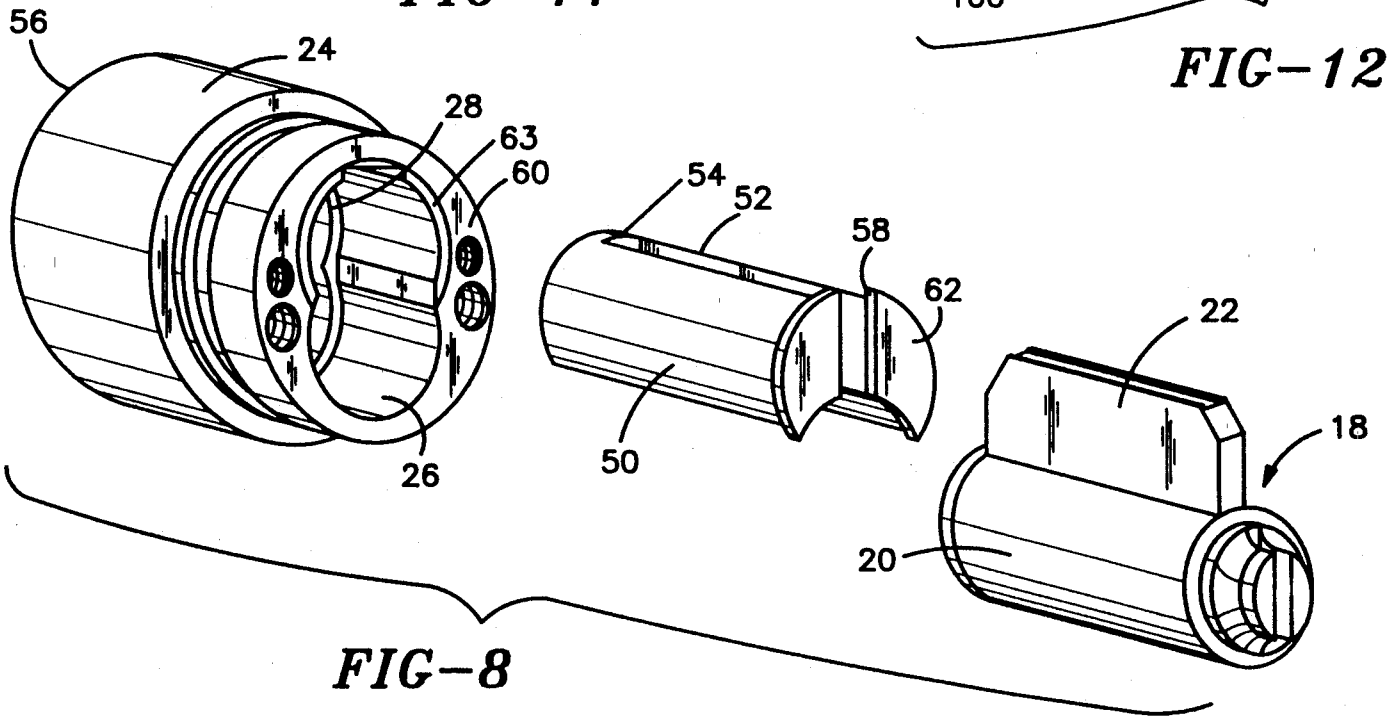
FIG. 8 is an exploded perspective view of another preferred embodiment of the invention.

The inside bore 26 of the housing 24 is sized larger than either the interchangeable core cylinder 10 or the insert cylinder 18. Thus, according to the invention, means for adapting the inside bore are provided to adapt inside bore 26 of housing 24 to the desired cylinder. With reference to FIGS. 6-8, the preferred embodiments of the adapting means according to the invention will be described.

FIG. 6, illustrates an adapting means for use with an interchangeable core cylinder 10, namely an adapting means 37 which preferably includes a sleeve 38 and plate 40. Sleeve 38 has a cutaway groove-like portion 42 and is disposed in inside bore 26 of housing 24 to reduce inside bore 26 of housing 24 to the size necessary for the interchangeable core cylinder 10. In this embodiment, plate 40 is disposed in slot 28 of housing 24 and has a protruding portion 44 which extends through both housing 24 and cutaway portion 42 of sleeve 38 to provide a ledge means within inside bore 26 operative to engage lug 16 on cylinder 10 and hold the cylinder 10 in place in housing 24. Cutout portion 42 of sleeve 38 extends along the wall of sleeve 38 and, when sleeve 38 is seated in bore 26, cutout portion 42 corresponds to cutback or flat region 36 of housing 24 to provide sufficient clearance for operation of locking lug 16 of interchangeable core cylinder 10. In this embodiment, when plate 40 is in place in slot 28 and cutout portion 42, plate 40 also serves as a means for fixing sleeve 38 in housing 24. Sleeve 38 may preferably have a series of indentations 45 as shown in FIGS. 6 and 7, which serve to facilitate the fit of interchangeable core cylinder 10 in sleeve 38 by providing a partly reduced effective inside sleeve diameter or contour.

With reference to FIG. 7, an alternate embodiment of the adapting means for an interchangeable core cylinder is shown. In this embodiment sleeve 38A has an integral protruding portion 46 which corresponds to extended region 34 of housing 24 and which provides the aforesaid ledge means for interacting with locking lug 16 of cylinder 10. Sleeve 38A also has a substantially straight wall portion 48 which corresponds to cut back or flat region 36 of inside bore 26 of housing 24, wall portion 48 having an edge portion 49 thereof. When sleeve 38A is disposed in housing 24, edge 49 of straight wall portion 48 provides a means to hold sleeve 38A in place in housing 24 by interacting with extended region 34 of inside bore 26. As can be seen, with this alternate sleeve 38A, no plate 40 is necessary to provide a ledge means or to hold the sleeve in place. Sleeve 38A may also be provided with indentations 45, as previously mentioned, to facilitate the fit of interchangeable core cylinder 10 in sleeve 38A.

FIG. 8 shows an adapting means according to the present invention, with an insert cylinder 18 as shown in FIG. 2. The adapting means preferably comprises an overlay member 50 having a cavity 52. The overlay member 50 is disposed over insert cylinder 18 to provide a combined contour corresponding to inside bore 26 of housing 24. Housing 24 includes a front face 56 and a rear face 60. Cavity 52 is shaped to receive rectangular section 22 of insert cylinder 18, and is closed at a first end 54 of the overlay member 50 which when seated in housing 24 corresponds to front face 56 of housing 24. The overlay member is open at second end 58 which when seated in housing 24 corresponds to rear face 60 of housing 24. The overlay member 50 also preferably has a flange 62 which mates with an inset portion 63 disposed around inside bore 26 of housing 24 at the rear face 60 thereof. In this described embodiment, the overlay member 50 is inserted into the inside bore 26 from rear face 60 of housing 24 and held in place by flange 62, and the insert cylinder 18 is inserted from the rear face 60 of the housing 24 through open second end 58 and held in place by closed first end 54 of the overlay member 50.

It should be noted that no ledge means is required for the aforesaid adapting means for use with an insert cylinder 18 because the insert cylinder 18 is not removable from the housing 24 in the same fashion that the interchangeable core cylinder 10 is as described in the previous embodiments.

It is also an object of the present invention to provide a transmission or lazy cam assembly which is affixed to the housing and can be used for either of the aforesaid cylinder types. The term "lazy cam", as used herein, refers to a structure which allows a degree of rotation of a lock cylinder without translating motion to the latch mechanism of the lock. This lazy cam action, or lost motion, is desirable in order to allow a key to be returned to the insert position after a lock is locked or unlocked so that the key can be removed. This type of lazy cam assembly is not necessary for locks operated by a turn knob, but is usually desired for locks operated by keys.

Figure 9:
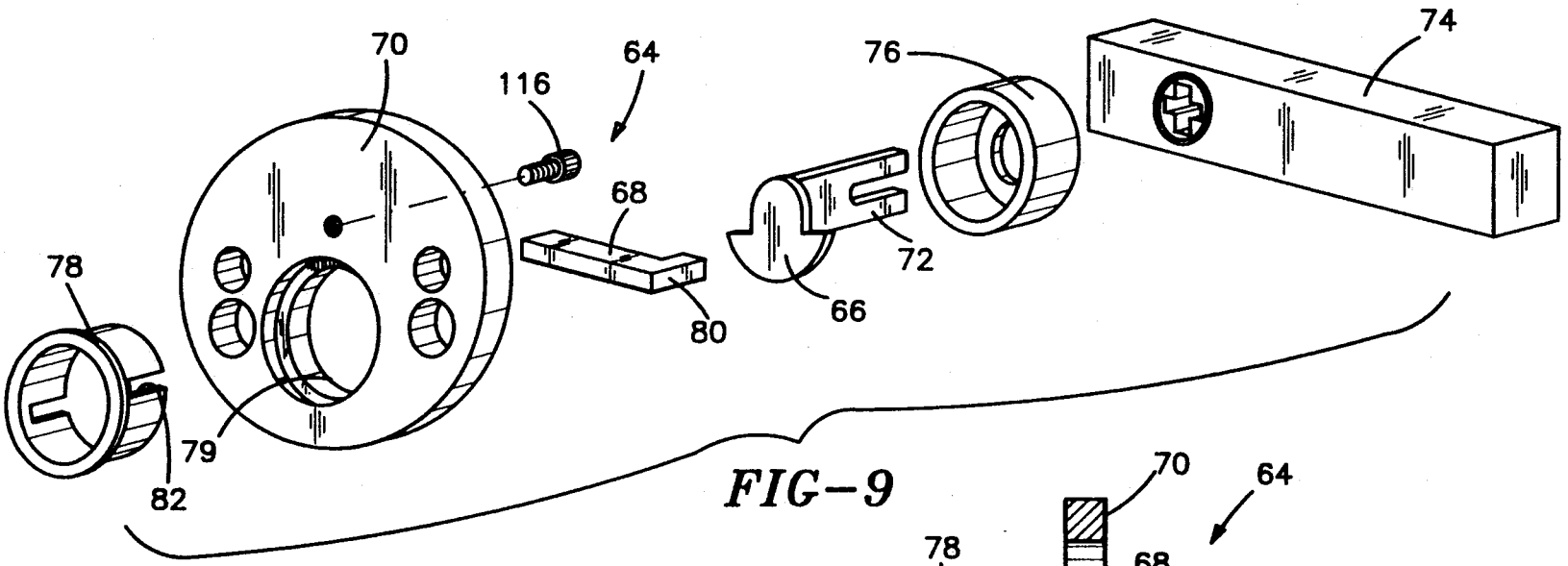
FIG. 9 is an exploded perspective view of a transmission assembly according to the invention.
Figure 10:
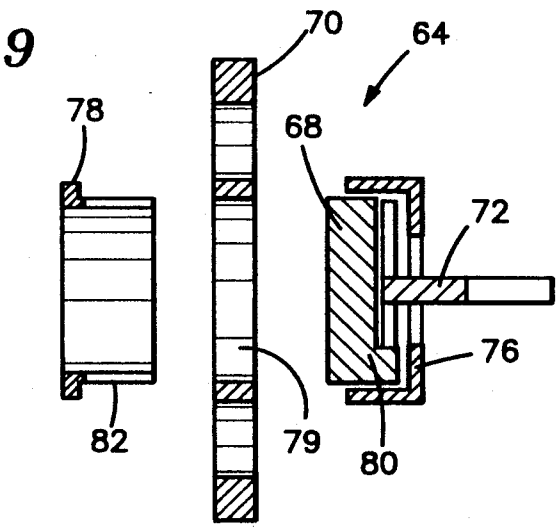
FIG. 10 is a cross sectional view of the transmission assembly.

Referring to FIGS. 9-10, the transmission assembly is generally referred to as element 64. Transmission assembly 64 preferably includes a cam plate 66 and a blade 68 rotatably disposed upon an assembly plate 70.

The cam plate 66 has a tail piece 72 which interacts with a latch mechanism 74 of the lock (schematically illustrated in FIG. 9). The latch mechanism 74 may be, for example, a dead bolt mechanism, knob lock mechanism, or any other type of lock known in the art.

Cam plate 66 and blade 68 are contained in outer cup means 76 and inner cup means 78. Outer cup means 76 and inner cup means 78 are preferably assembled from either side of aperture 79 in assembly plate 70 and are held together through any means known in the art, such as, for example, a press fit, snap means, welding, glue, etc.

Blade 68 has a projecting portion 80 which extends into the plane of rotation of the cam plate 66. Blade 68 may preferably be disposed in grooves 82 located in inner cup means 78, and may alternatively float freely inside inner cup means 78, or be manufactured as an integral portion of inner cup means 78.

Various degrees of lost motion may be provided by altering the shape of cam plate 66. Thus, lost motion may be provided in a range of, for example, 30°-330°. Further, cam plate 66 could be adapted to provide a fixed drive (no lost motion) where such a transmission is desired.

Assembly plate 70 is mounted to housing 24 through any desired means known in the art, and also serves to hold the cylinder and adapting means in inside bore 26 of housing 24, as more fully described in the description of FIG. 13 below.

Blade 68 interacts with the cylinder, as previously mentioned, to transmit rotation to the latch mechanism 74 of the lock assembly. Interchangeable core cylinders 10, however, have a different rear face or plug than do insert cylinders 18. According to the invention, the transmission assembly is modified to interact with the plug of either cylinder. The interaction of blade 68 with the cylinder is illustrated in FIGS. 11-12 described hereinbelow.

Figure 11:
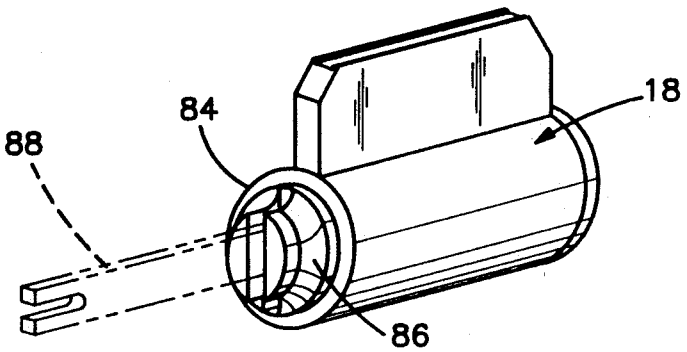
FIG. 11 is a perspective rear view of the insert cylinder of FIG. 2.

Referring to FIG. 11, an insert cylinder 18 has a rear face 84 having a grooved plug 86. Grooved plug 86 interacts with blade 68 of the transmission assembly. Such a grooved plug 86 is obtained by removing a conventional tail piece 88, shown in dashed lines in FIG. 11, from a conventional insert cylinder.

Figure 12:
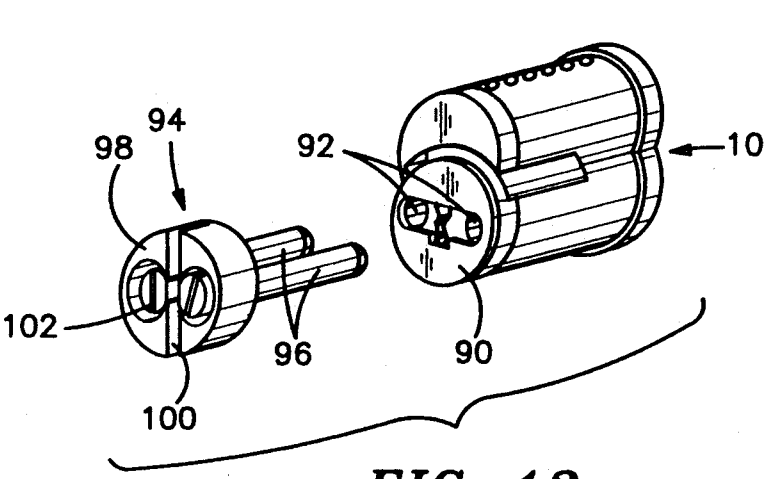
FIG. 12 is an exploded perspective rear view of the interchangeable core cylinder of FIG. 1 and a plug adaptor therefor, according to the invention.

Referring to FIG. 12, the rear face or plug 90 of an interchangeable core cylinder 10 is shown. Conventional interchangeable core cylinders 10 have two channels 92 which are located in the rear face 90 of the cylinder.

A plug adaptor 94 is used, according to the invention, to modify the transmission assembly to use with rear face 90. Adaptor plug 94 has a head portion 98 having a groove 100. The groove 100 preferably has a clamp means 102 disposed thereon to provide releasable but secure interaction of groove 100 with blade 68 of the lazy cam assembly. The clamp means 102 may comprise any means known in the art for providing a press or snap fit of groove 100 over blade 68. The function of clamp means 102 is to secure adaptor plug 94 to the transmission assembly when an interchangeable core cylinder 10 is used. Adaptor plug 94 has projecting pins 96 which are slideably disposed in the channels 92 of the interchangeable core cylinder 10. Thus, when a user removes interchangeable core cylinder 10 from housing 24, adaptor plug 94 will remain in place in the housing.

Thus, as can be seen, the housing according to the invention may be provided with a transmission assembly having a blade disposed for interaction with an insert cylinder type lock, and which blade can be modified for use with an interchangeable core cylinder type lock.

Figure 13:
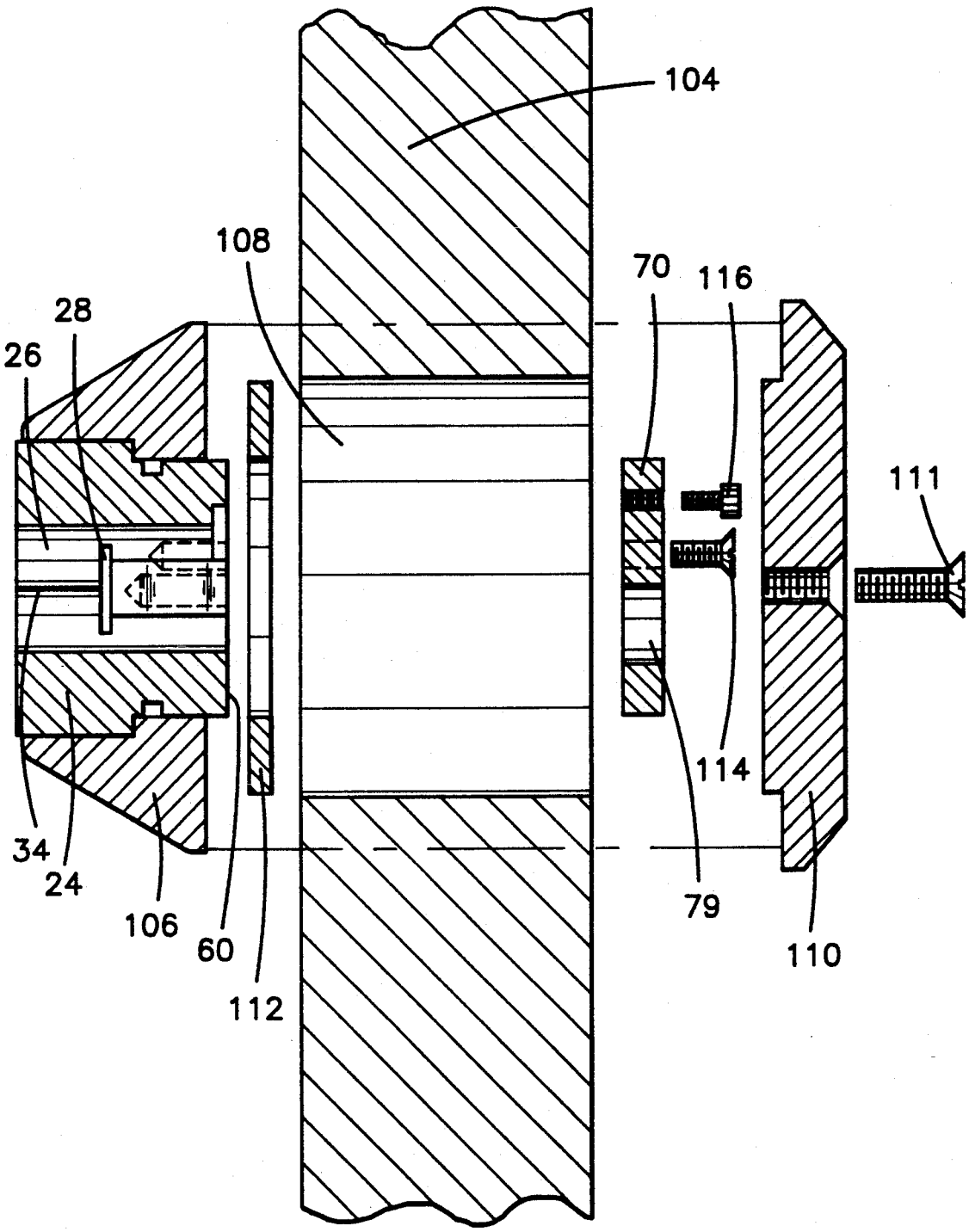
FIG. 13 is a cross sectional view of a housing, according to the invention, in its environment.

FIG. 13 shows a cross section according to the invention, in an environment of use. For simplicity, the cylinder, adapting means and transmission assembly are not shown. Housing 24 may preferably be mounted in door 104 using a free spinning rose or sleeve 106. Rose 106 protects housing 24 against forcible rotational manipulation. As is known, housing 24 is preferably held in the face bore, or knob hole 108 of door 104 by a fixture mounted to the opposite side of the door 104 such as, for example, plate 110 which may accommodate a turn knob or another cylinder and rose (not shown). Plate 110 is preferably mounted to housing 24 through any conventional means such as screw means 111.

Housing 24 may be more securely mounted in knob holes 108 of differing size through the use of a bushing 112 sized to fit snugly between housing 24 and knob hole 108. Bushing 112 adapts the outer diameter of housing 24 to the size of knob hole 108 and helps prevent forcible horizontal and/or vertical manipulation of housing 24.

As previously mentioned, assembly plate 70 of transmission assembly 64 serves the additional function of holding the cylinder and adapting means in place from the rear of housing 24. Assembly Plate 70 is affixed to rear face 60 of housing 24 through any means known in the art such as, for example, screw means 114.

It is anticipated that housing 24 may be used with cylinders having a length shorter than inside bore 26 of housing 24. A take up screw 116 (also shown in FIG. 9) may preferably be disposed in assembly plate 70 to prevent "end play", or longitudinal movement of a cylinder of either type in inside bore 26. Take up screw 116 can be threaded and unthreaded through assembly plate 70 to contact the cylinder/adapting means assembly and prevent "end play".

It should be noted that the features of the invention can advantageously be combined, for use with a dead bolt, with a device providing an adjustable dead bolt backset such as the device disclosed in U.S. Pat. No. 4,639,025 to Fann et al. Such a combination would further the overall object of the invention of providing a lock adaptable to diverse uses with a minimum number of parts.

It should also be noted that adapting means may be provided in accordance with the invention, to allow use of interchangeable core and insert cylinders of different sizes.

Thus described is a lock which can be used by locksmiths to greatly reduce the number of pieces which must be carried in order to effectively respond to the diverse needs of the user of the lock. The housing 24 of the lock is identical for use with either the interchangeable core type cylinder 10 or the insert type cylinder 18, and the parts required for adapting the housing 24 to either cylinder are few in number, small, and simple to use.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A lock, comprising:

a housing having an inside bore, a front face and a rear face;

cylinder means, comprising an interchangeable core cylinder having a control key actuated locking lug for allowing the interchangeable core cylinder to be installed and removed through the front face of the housing, and an insert cylinder adapted for installation from the rear face of the housing;

means for adapting the inside bore of the housing to correspond to an outer contour of the interchangeable core cylinder and an outer contour of the insert cylinder, the inside bore of the housing being at least as large at any point as the outer contour of the interchangeable core cylinder and the outer contour of the insert cylinder, the adapting means comprising a sleeve for use with the interchangeable core cylinder, the sleeve having an inside contour corresponding to the outer contour of the interchangeable core cylinder, and having a ledge means for interacting with the locking lug of the interchangeable core cylinder, and an overlay member for use with the insert cylinder, the overlay member being disposed within the inside bore of the housing so as to receive the insert cylinder from the rear face of the housing, whereby the housing is adapted to receive either of the interchangeable core cylinder and the insert cylinder.

2. A lock according to claim 1, further comprising means for adapting an outer diameter of the housing to a knob hole in which the housing is to be installed.

3. A lock according to claim 1, wherein the ledge means comprises a plate disposed within the housing and protruding through the sleeve into the inside bore of the housing.

4. A lock according to claim 1, wherein the ledge means comprises an integral projecting portion of the sleeve.

5. A lock according to claim 1, wherein the means for adapting further includes indentation means disposed on the sleeve whereby fit of the interchangeable core cylinder in the sleeve is facilitated.

6. A lock according to claim 1, wherein the overlay member has a cavity for interacting with the insert cylinder, the cavity being closed at a first end corresponding in location to the front face of the housing, and being open at a second end corresponding in location to the rear face of the housing, so that the insert cylinder is held in the overlay member against motion out of the first end of the overlay member, the overlay member having a flange which interacts with the housing whereby the overlay member is held in the housing against motion out of the front face of the housing.

7. A lock according to claim 1, further comprising a transmission means mounted to the housing and cooperating with the cylinder means to impart desired motion to a latch mechanism of the lock.

8. A lock according to claim 7, wherein the transmission means comprises:

an assembly plate mounted to the housing;

a cam plate rotatably mounted to the assembly plate in registry with a blade;

a tail piece protruding from the cam plate for interaction with the latch mechanism; and means for imparting rotation from the cylinder means to the blade; the rotation imparting means comprising a plug adaptor for use with the interchangeable core cylinder, the plug adaptor being connected to the blade of the transmission means and cooperating with the interchangeable core cylinder, and a grooved plug for use with the insert cylinder, the grooved plug being connected to the insert cylinder and cooperating with the blade of the transmission means, whereby the transmission means is operative to be used with either of the interchangeable core cylinder and the insert cylinder.

9. A lock according to claim 8, wherein the plug adaptor is releasably connected to the blade.

10. A lock according to claim 8, wherein the plug adaptor further comprises clamp means for secure and releasable attachment of the plug adaptor to the blade.

11. A lock according to claim 10, wherein the plug adaptor comprises a head piece upon which the clamp means is located and at least two pins, extending from the head piece for slideable engagement with the interchangeable core cylinder.

12. A lock according to claim 1, further including a transmission means mounted to the housing and cooperating with the interchangeable core cylinder to impart desired motion to a latch mechanism of the lock.

13. A lock according to claim 1, further comprising a transmission means mounted to the housing and cooperating with the insert cylinder to impart desired motion to a latch mechanism of the lock.

14. A lock according to claim 1, further including a bushing for sizing an outer diameter of the housing to a desired knob hole size.

15. A lock according to claim 14, further including a free-spinning sleeve mounted around the housing to prevent forcible rotational manipulation of the housing.

* * * * *